US007967566B2

(12) United States Patent
Liang

(10) Patent No.: US 7,967,566 B2
(45) Date of Patent: Jun. 28, 2011

(54) THERMALLY BALANCED NEAR WALL COOLING FOR A TURBINE BLADE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 1233 days.

(21) Appl. No.: 11/715,704

(22) Filed: Mar. 8, 2007

(65) Prior Publication Data

US 2009/0068021 A1 Mar. 12, 2009

(51) Int. Cl.
*F01D 5/18* (2006.01)

(52) U.S. Cl. ..... 416/97 R

(58) Field of Classification Search ..... 415/115; 416/97 R, 96 A, 96 R
See application file for complete search history.

(56) References Cited

U.S. PATENT DOCUMENTS 5,165,852 A * 11/1992 Lee et al. ..... 416/97 R
5,993,155 A 11/1999 Endres et al.
6,220,817 B1 * 4/2001 Durgin et al. ..... 416/97 R
6,379,118 B2 4/2002 Lutum et al.
6,478,535 B1 11/2002 Chung et al.
6,705,836 B2 * 3/2004 Bourriaud et al. ..... 416/97 R
6,974,308 B2 * 12/2005 Halfmann et al. ..... 416/97 R
7,413,407 B2 * 8/2008 Liang ..... 416/97 R
7,442,008 B2 * 10/2008 Kopmels et al. ..... 416/97 R
2006/0002795 A1 * 1/2006 Liang ..... 416/97 R
2006/0056967 A1 3/2006 Liang

OTHER PUBLICATIONS

U.S. Appl. No. 11/527,307, filed Sep. 2006, Liang George.*

* cited by examiner

*Primary Examiner* — Edward Look
*Assistant Examiner* — Jesse Prager

(57) ABSTRACT

A turbine blade including an airfoil having an airfoil outer wall extending radially outwardly from a blade root to a blade tip. The airfoil outer wall includes a pressure sidewall and a suction sidewall, and the pressure and suction sidewalls are joined together at chordally spaced leading and trailing edges of the airfoil. A pressure side serpentine cooling path extends adjacent the pressure sidewall and a suction side serpentine cooling path extends adjacent the suction sidewall. The pressure side cooling path conducts cooling fluid in a first chordal direction between the leading and trailing edges, and the suction side cooling path conducts cooling fluid in a second chordal direction, opposite the first chordal direction, between the leading and trailing edges. A central partition extends chordally through the airfoil, and a transverse passage extends through the central partition and connects the pressure side cooling path to the suction side cooling path.

17 Claims, 7 Drawing Sheets

THERMALLY BALANCED NEAR WALL COOLING FOR A TURBINE BLADE

FIELD OF THE INVENTION

This invention is directed generally to turbine blades and, more particularly, to a turbine blade having cooling cavities for conducting a cooling fluid through an airfoil of the blade to provide an improved thermal balance in the cooling of the pressure and suction sides of the blade.

BACKGROUND OF THE INVENTION

A conventional gas turbine engine includes a compressor, a combustor and a turbine. The compressor compresses ambient air which is supplied to the combustor where the compressed air is combined with a fuel and ignites the mixture, creating combustion products defining a working gas. The working gas is supplied to the turbine where the gas passes through a plurality of paired rows of stationary vanes and rotating blades. The rotating blades are coupled to a shaft and disc assembly. As the working gas expands through the turbine, the working gas causes the blades, and therefore the shaft and disc assembly, to rotate.

Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades comprise a root, a platform and an airfoil that extends outwardly from the platform. The airfoil is ordinarily composed of a tip, a leading edge and a trailing edge. Most blades typically contain internal cooling channels forming a cooling system. The cooling channels in the blades may receive air from the compressor of the turbine engine and pass the air through the blade. The cooling channels often include multiple flow paths that are designed to maintain the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

It has been observed that the suction side of a turbine blade airfoil, immediately downstream of the leading edge, and the pressure side trailing edge portion of the airfoil experience a higher transfer of heat from the hot gases passing over the airfoil than the heat transfer at the mid-chord portion of the pressure side and the downstream portions of the suction side. Accordingly, it is desirable to increase the transfer of heat from and the cooling to the hotter portions of the airfoil, such as by conduction of heat from the hotter areas toward cooler areas of the airfoil and by controlled flow of a cooling fluid through interior passages in the airfoil.

SUMMARY OF THE INVENTION

In accordance with one aspect of the invention, a turbine blade is provided comprising an airfoil including an airfoil outer wall extending radially outwardly from a blade root to a blade tip. The airfoil outer wall includes a pressure sidewall and a suction sidewall, and the pressure and suction sidewalls are joined together at chordally spaced leading and trailing edges of the airfoil. A pressure side serpentine cooling path extends adjacent the pressure sidewall and a suction side serpentine cooling path extends adjacent the suction sidewall. The pressure side cooling path conducts cooling fluid in a first chordal direction between the leading and trailing edges, and the suction side cooling path conducts cooling fluid in a second chordal direction, opposite the first chordal direction, between the leading and trailing edges.

In accordance with another aspect of the invention, a turbine blade is provided comprising an airfoil including an airfoil outer wall extending radially outwardly from a blade root to a blade tip. The airfoil outer wall includes a pressure sidewall and a suction sidewall, and the pressure and suction sidewalls are joined together at chordally spaced leading and trailing edges of the airfoil. At least two pressure side cooling cavities are located adjacent the pressure sidewall, and at least two suction side cooling cavities are located adjacent the suction sidewall. A source of a cooling fluid is in communication with at least one of the pressure side cooling cavities, and at least one pressure side passage extends in a chordal direction for conducting cooling fluid in a first chordal direction between the at least two pressure side cooling cavities. A transverse passage extends between a downstream one of the pressure side cooling cavities and one of the suction side cavities, and at least one suction side passage extends in a chordal direction for conducting cooling fluid in a second chordal direction between the at least two suction side cavities.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
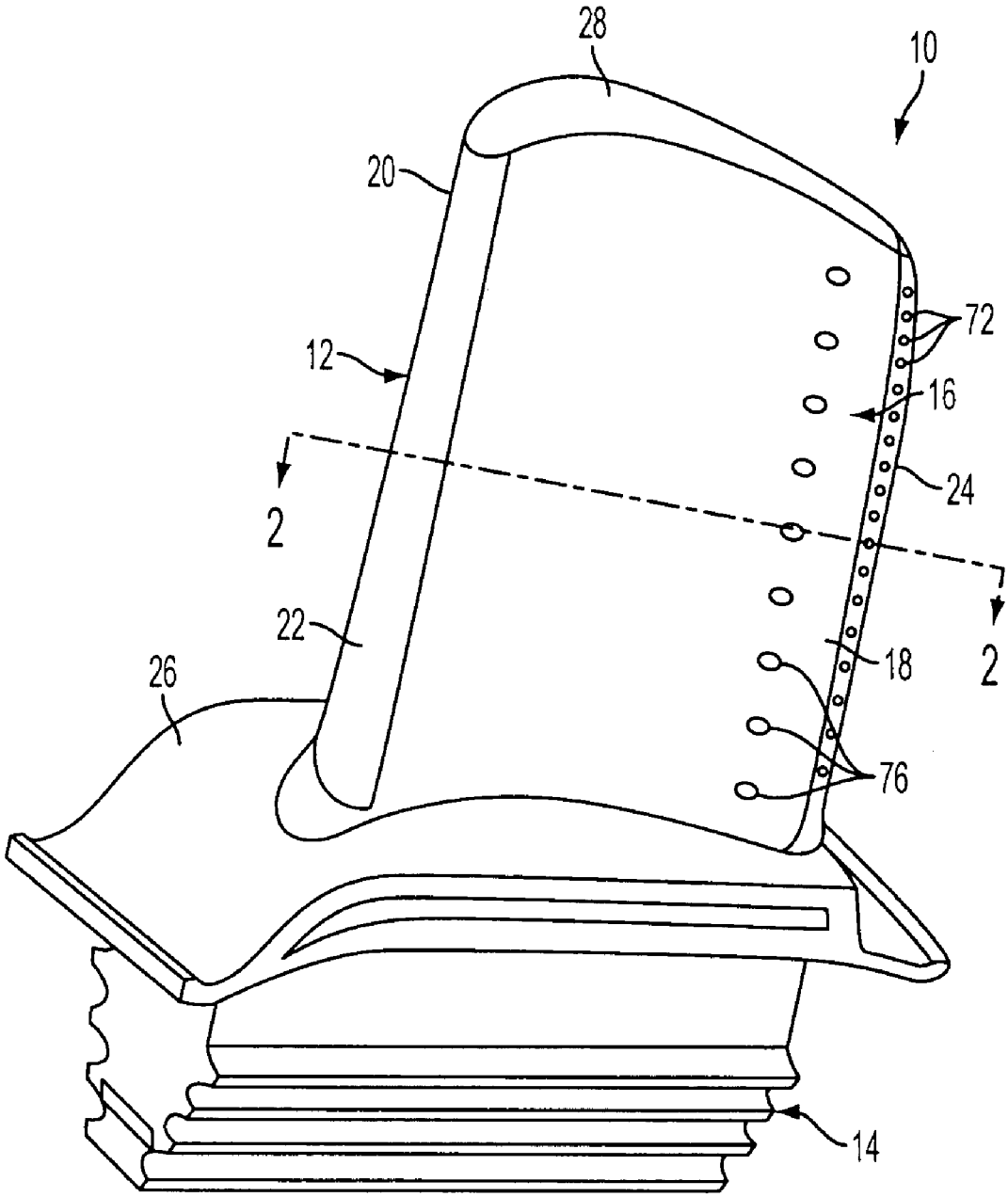
FIG. 1 is a perspective view of a turbine blade incorporating the present invention.

Referring to FIG. 1, an exemplary turbine blade 10 for a gas turbine engine is illustrated. The blade 10 includes an airfoil 12 and a root 14 which is used to conventionally secure the blade 10 to a rotor disk of the engine for supporting the blade 10 in the working medium flow path of the turbine where working medium gases exert motive forces on the surfaces thereof. The airfoil 12 has an outer wall 16 comprising a generally concave pressure sidewall 18 and a generally convex suction sidewall 20. The pressure and suction sidewalls 18, 20 are joined together along an upstream leading edge 22 and a downstream trailing edge 24. The leading and trailing edges 22, 24 are spaced axially or chordally from each other. The airfoil 12 extends radially along a longitudinal or radial direction of the blade 10, defined by a span of the airfoil 12, from a radially inner airfoil platform 26 to a radially outer blade tip surface 28.

Figure 2:
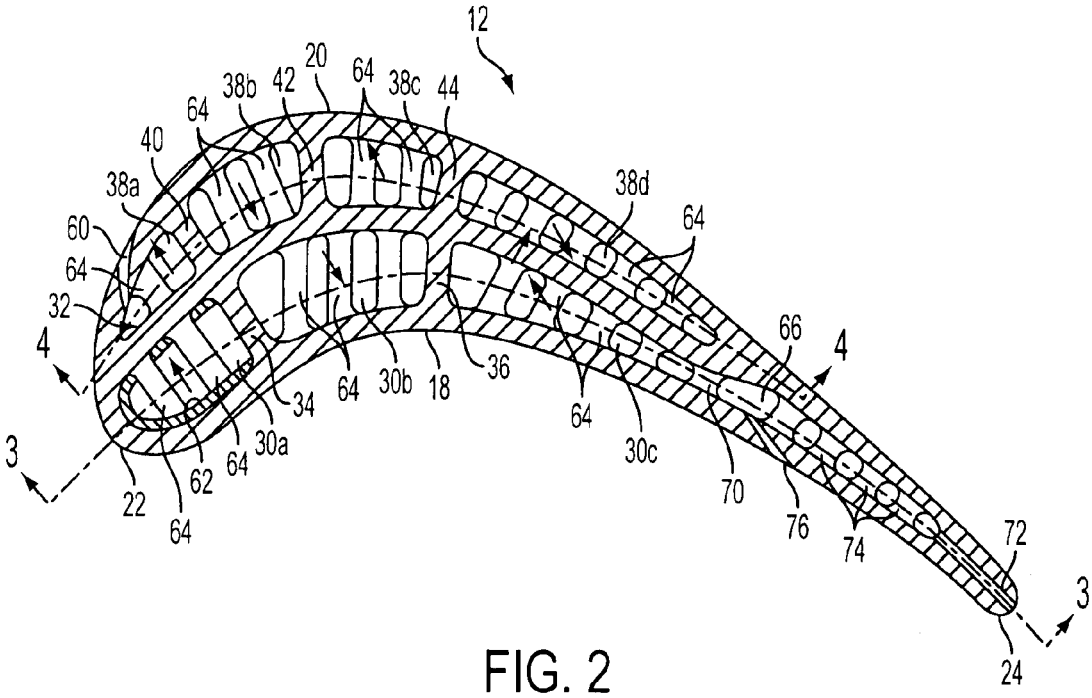
FIG. 2 is a cross-sectional view of the turbine blade shown in FIG. 1 taken along line 2-2.
Figure 3:
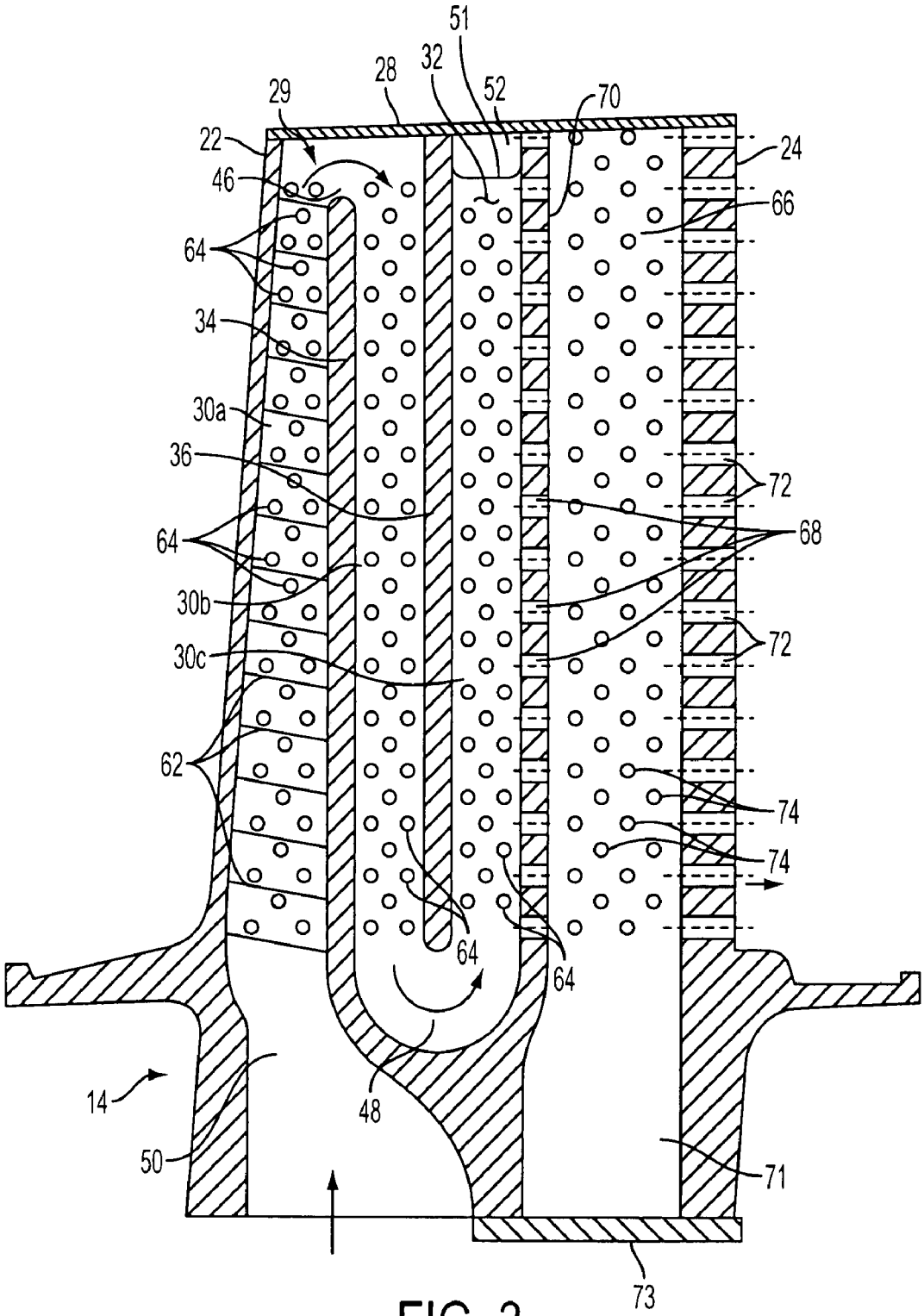
FIG. 3 is a cross-sectional view of the turbine blade shown in FIG. 2 taken along line 3-3.

Referring to FIGS. 2 and 3, the airfoil 12 includes a pressure side serpentine cooling path 29 defined by a plurality of pressure side cooling cavities 30*a*, 30*b*, 30*c* extending in a spanwise direction between the blade root 14 and the blade tip 28. The pressure side cavities 30*a*, 30*b*, 30*c* are defined between the pressure sidewall 18, defining an outer wall of the pressure side cavities 30*a*, 30*b*, 30*c*, and a central partition 32 extending chordally through a central portion of the airfoil 12 and defining an inner wall of the pressure side cavities 30*a*, 30*b*, 30*c*. In the illustrated embodiment, the pressure side serpentine path 29 comprises a first cavity 30*a* separated from a second cavity 30*b* by a first pressure side partition 34, and a third cavity 30*c* separated from the second cavity 30*b* by a second pressure side partition 36.

Figure 4:
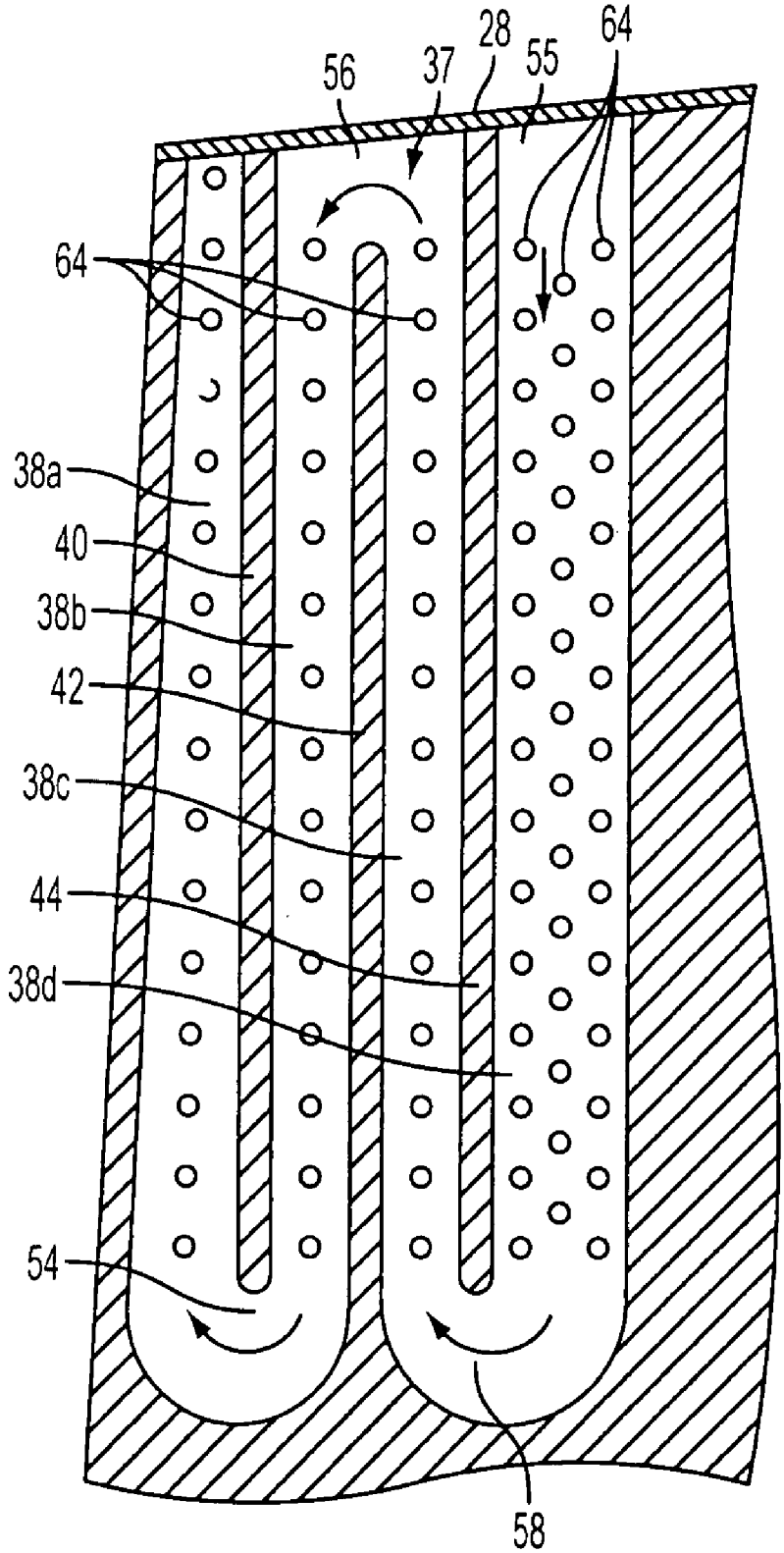
FIG. 4 is a cross-sectional view of the turbine blade shown in FIG. 2 taken along line 4-4.

Referring to FIGS. 2 and 4, the airfoil 12 includes a suction side serpentine cooling path 37 defined by a plurality of suction side cooling cavities 38*a*, 38*b*, 38*c*, 38*d* extending in a spanwise direction between the blade root 14 and the blade tip 28. The suction side cavities 38*a*, 38*b*, 38*c*, 38*d* are defined between the suction sidewall 20, defining an outer wall of the suction side cavities 38*a*, 38*b*, 38*c*, 38*d* and the central partition 32, defining an inner wall of the suction side cavities 38*a*, 38*b*, 38*c*, 38*d*. The suction side serpentine path 37 comprises a first cavity 38*a* separated from a second cavity 38*b* by a first suction side partition 40, a third cavity 38*c* separated from the second cavity 38*b* by a second suction side partition 42, and a fourth cavity 38*d* separated from the third cavity 38*c* by a third suction side partition 44.

Referring to FIG. 3, a first pressure side passage 46 extends in a chordal direction between the first pressure side cavity 30*a* and the second pressure side cavity 30*b*, adjacent the blade tip 28. A second pressure side passage 48 extends in a chordal direction between the second pressure side cavity 30*b* and the third pressure side cavity 30*c*. A supply of cooling fluid, such as cooling air supplied from the compressor for the turbine engine, is provided via the blade root 14 to the airfoil through an opening 50 to supply cooling fluid to the first pressure side chamber 30*a*. The cooling fluid flows in the pressure side serpentine path 29 in a downstream chordal direction, relative to the flow direction of the hot gases passing over the outer wall 16 of the airfoil 12, i.e., generally parallel to and in same direction as the hot gas flow. The cooling fluid passes out of the pressure side serpentine path 29 into the suction side serpentine path 37 through a transverse passage 52 defined through the central partition 32 at an upper edge 51 of the central partition 32 adjacent to the blade tip 28. Accordingly, cooling fluid passes from the third pressure side cavity 30*c* to the fourth suction side cavity 38*d* through the transverse passage 52.

Referring to FIG. 4, the suction side serpentine path 37 comprises a first suction side passage 54 extending in a chordal direction from the first suction side cavity 38*a* to the second suction side cavity 38*b* adjacent the blade root 14, a second suction side passage 56 extending in a chordal direction from the second suction side cavity 38*b* to the third suction side cavity 38*c* adjacent the blade tip 28, and a third suction side passage 58 extending in a chordal direction from the third suction side cavity 38*c* to the fourth suction side cavity 38*d* adjacent to the blade root 14. The cooling fluid flows in the suction side serpentine path 37 in an upstream chordal direction, relative to the flow direction of the hot gases passing over the outer wall 16 of the airfoil 12, i.e., generally parallel to and in a counterflow direction relative to the direction of hot gas flow and relative to the flow in the pressure side serpentine path 29. The cooling fluid passes out of the suction side serpentine path 37 at the first suction side cavity 38*a* through a plurality of openings 60 (only one shown in FIG. 2) provided spaced in a spanwise direction in the suction sidewall 20. The openings 60 provide a film of cooling fluid to the suction sidewall 20 immediately downstream of the leading edge 22, where higher temperatures are typically experienced by the suction side of the airfoil 12. The openings 60 may comprise shaped openings to reduce the flow velocity of the cooling fluid as it exits the cooling holes 60. For example, each of the cooling holes 60 may be formed in accordance with the teachings of U.S. Pat. No. 6,183,199, which patent is incorporated herein by reference.

Referring to FIGS. 2 and 3, the first pressure side cavity 30*a* comprises a leading edge cooling supply cavity. The cooling fluid enters the airfoil 12 through the opening 50 at its lowest temperature and initially provides cooling to the leading edge region, where the external heat load on the airfoil 12 is generally the greatest. The side walls of the first pressure side cavity 30*a* may further be provided with trip strips 62 along the interior surfaces thereof. The trip strips 62 increase turbulence of the cooling fluid flow along the interior surfaces, and thereby improve heat transfer at the boundary layer between the cooling fluid flow and the interior surfaces of the first pressure side cavity 30*a*.

As seen in FIGS. 2-4, heat transfer and balancing of the heat load throughout the airfoil 12 is further facilitated by a plurality of pin fins 64, defining banks of pin fins 64 in each of the pressure side cavities 30*a*, 30*b*, 30*c* and suction side cavities 38*a*, 38*b*, 38*c*, 38*d*. The pin fins 64 on the pressure side of the airfoil 12 extend from the interior surface of the pressure sidewall 18 to the central partition 32, and pin fins 64 on the suction side of the airfoil 12 extend from the suction sidewall 20 to the central partition 32. The pin fins 64 conduct heat from the airfoil outer wall 16 to the central partition 32, and increase turbulence and heat transfer to the cooling fluid passing through the serpentine paths 29, 37. In addition, the connection of the pin fins 64 to the common central partition 32 from both the pressure sidewall 18 and the suction sidewall 20 permits transfer of heat from a hotter side to a cooler side of the airfoil 12. For example, heat from a hotter region of the airfoil 12 at the suction sidewall 20 adjacent to the first suction side cavity 38*a* may be transferred to the central partition 32 via the pin fins 64 extending through the cavity 38*a*, and heat may be transferred from the central partition 32 in this region to the cooler first pressure side cavity 30*a* via the pin fins 64 extending through the cavity 30*a*. In this manner, a balance of the thermal load may be maintained between hotter and adjacent cooler regions of the airfoil outer wall 16.

As seen in FIGS. 2 and 3, the airfoil 12 additionally includes a trailing edge cavity 66 that is defined between the pressure sidewall 18 and the suction sidewall 20 adjacent the trailing edge 24. The trailing edge cavity 66 is in fluid communication with the third pressure side cavity 30*c* via a plurality of metering holes 68 defined in a rib 70. In the illustrated embodiment, an opening 71 in the trailing edge cavity 66, adjacent the blade root 14, is closed by a cover plate 73, and the trailing edge cavity 66 receives cooling fluid from the third pressure side cavity 30*c* for cooling the trailing edge region of the airfoil 12. A plurality of trailing edge cooling holes 72 are provided in the trailing edge 24 of the airfoil 12 for exit of the cooling fluid from the trailing edge cavity 66. A plurality of pin fins 74 are provided extending through the trailing edge cavity 66 for balancing the thermal distribution between the pressure sidewall 18 and the suction sidewall 20. Further, a plurality of openings 76 are provided spaced in a spanwise direction in the pressure sidewall 18, as also may be seen in FIG. 1. The openings 76 are located ahead of the bank of pin fins 74 in the trailing edge cavity 66 to provide a film of cooling fluid to the pressure sidewall 18 in an area adjacent the trailing edge 24 where higher temperatures are typically experienced by the pressure side of the airfoil 12. The openings 76 may comprise shaped openings, such as those described in the above-referenced U.S. Pat. No. 6,183,199.

Referring to FIGS. 3 and 4, the airfoil receives cooling fluid through the opening 50 and the cooling fluid passes sequentially in alternating spanwise directions through the first, second and third pressure side cavities 30*a*, 30*b*, 30*c*, flowing in a chordal direction from the leading edge 22 toward the trailing edge 24 as it passes through the first and second pressure side passages 46, 48. At the end of the pressure side serpentine path 29, the cooling fluid passes through the transverse passage 52 into the suction side serpentine path 37, at the area generally identified by 55 in FIG. 4. The cooling fluid then passes sequentially in alternating spanwise directions through the fourth, third, second and first suction side cavities 38*d*, 38*c*, 38*b*, 38*a*, flowing in a chordal direction from the trailing edge 24 toward the leading edge 22 as it passes through the third, second and first pressure side passages 58, 56, 54. The cooling fluid then passes out of the first suction side cavity 38*a* through the openings 60 to form a cooling fluid film over the region of the suction sidewall 18 adjacent the leading edge 22.

Figure 5:
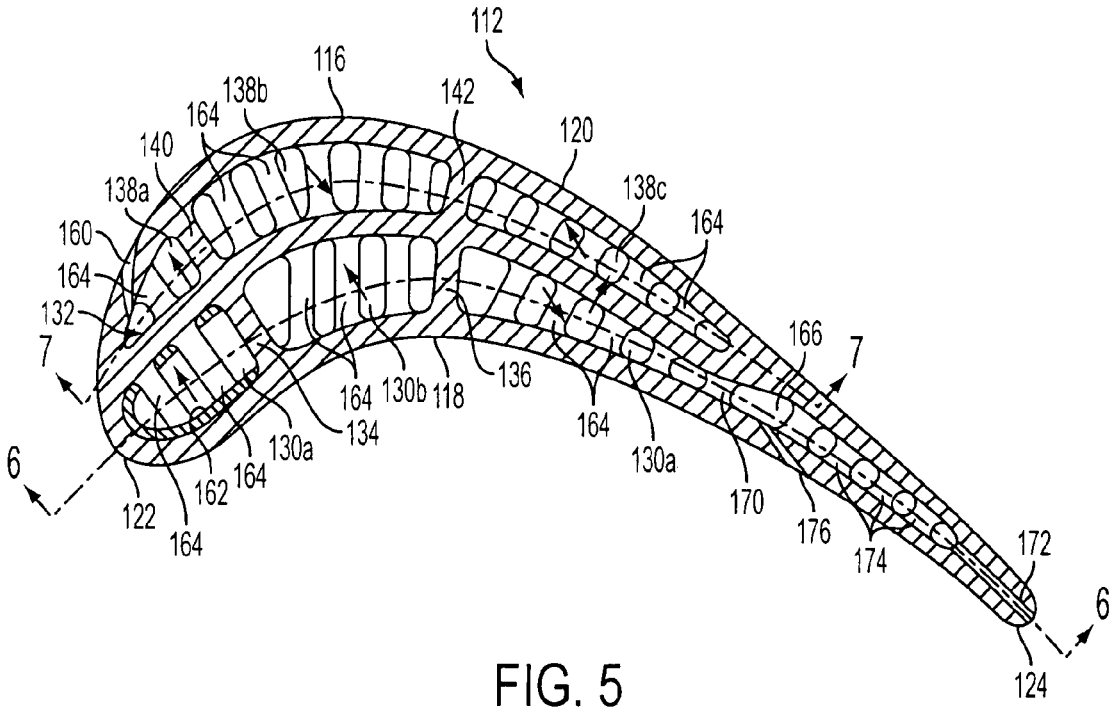
FIG. 5 is a cross-sectional view similar to the cross-sectional view of FIG. 2 and showing a second embodiment of the invention.
Figure 6:
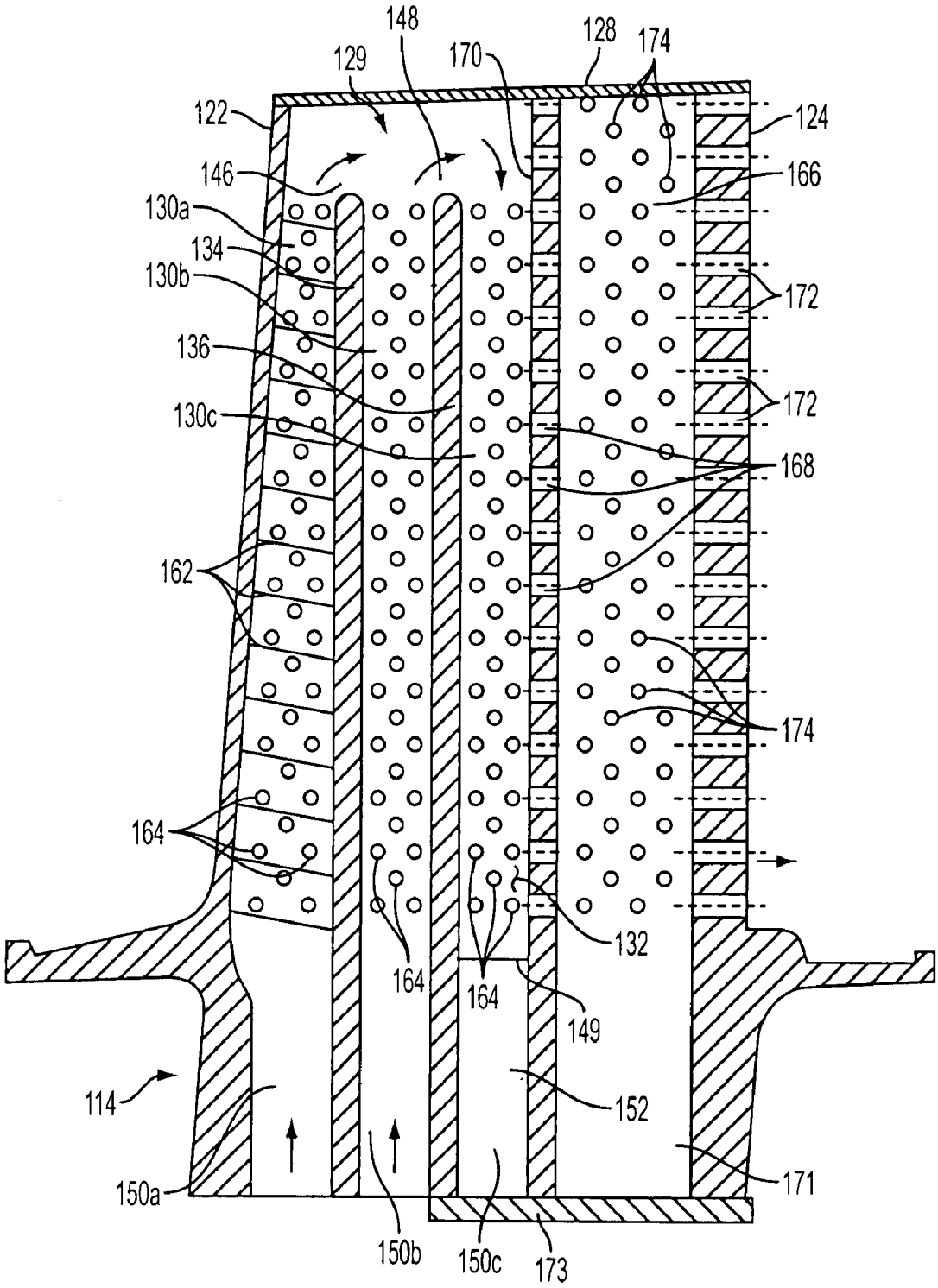
FIG. 6 is a cross-sectional view of the turbine blade shown in FIG. 5 taken along line 6-6.
Figure 7:
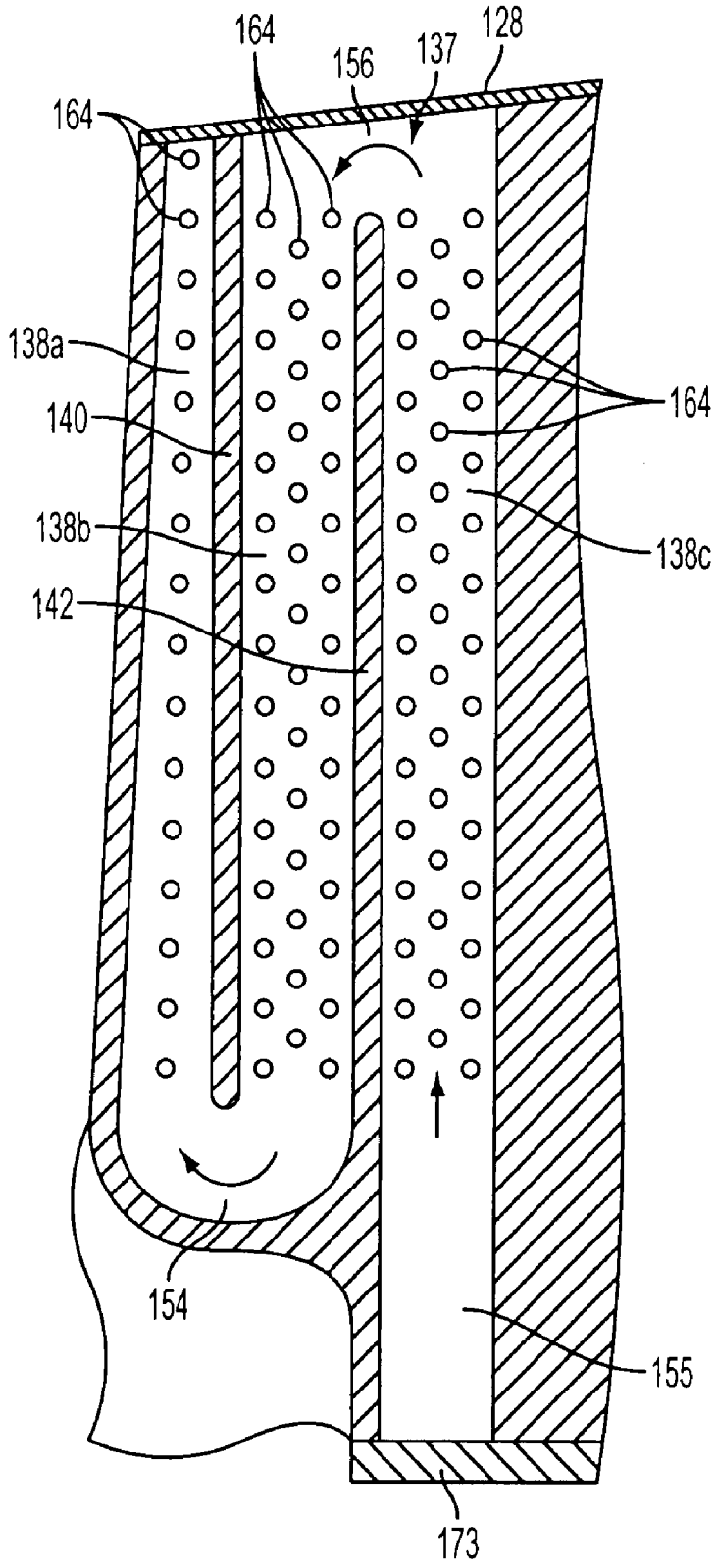
FIG. 7 is a cross-sectional view of the turbine blade shown in FIG. 5 taken along line 7-7.

Referring to FIGS. 5-7, a second embodiment of the airfoil 12 is illustrated, and in which elements of the second embodiment corresponding to elements of the first described embodiment of FIGS. 2-4 are identified with the same reference numeral increased by 100.

Referring to FIGS. 5 and 6, the airfoil 112 includes a pressure side serpentine cooling path 129 defined by a plurality of pressure side cooling cavities 130*a*, 130*b*, 130*c* extending in a spanwise direction between the blade root 114 and the blade tip 128. The pressure side cavities 130*a*, 130*b*, 130*c* are defined between the pressure sidewall 118, defining an outer wall of the pressure side cavities 130*a*, 130*b*, 130*c*, and a central partition 132 extending chordally through a central portion of the airfoil 112 and defining an inner wall of the pressure side cavities 130*a*, 130*b*, 130*c*. In the illustrated embodiment, the pressure side serpentine path 129 comprises a first cavity 130*a* separated from a second cavity 130*b* by a first pressure side partition 134, and a third cavity 130*c* separated from the second cavity 130*b* by a second pressure side partition 136. In addition, a trailing edge cavity 166 is provided adjacent the pressure side serpentine path 129, separated from the third pressure side cavity by a rib 170.

Referring to FIGS. 5 and 7, the airfoil 112 includes a suction side serpentine cooling path 137 defined by a plurality of suction side cooling cavities 138*a*, 138*b*, 138*c* extending in a spanwise direction between the blade root 114 and the blade tip 128. The suction side cavities 138*a*, 138*b*, 138*c* are defined between the suction sidewall 20, defining an outer wall of the suction side cavities 138*a*, 138*b*, 138*c* and the central partition 132, defining an inner wall of the suction side cavities 138*a*, 138*b*, 138*c*. The suction side serpentine path 137 comprises a first cavity 138*a* separated from a second cavity 138*b* by a first suction side partition 140, and a third cavity 138*c* separated from the second cavity 138*b* by a second suction side partition 142.

Referring to FIG. 6, a first pressure side passage 146 extends in a chordal direction between the first pressure side cavity 130*a* and the second pressure side cavity 130*b*, adjacent the blade tip 128. A second pressure side passage 148 extends in a chordal direction between the second pressure side cavity 130*b* and the third pressure side cavity 130*c* adjacent the blade tip 128. One or more fluid openings 150*a*, 150*b*, 150*c*, 171 may extend from the blade root 114 for supplying cooling fluid to the interior of the airfoil 112. One or more of the fluid openings 150*a*, 150*b*, 150*c*, 171 may be closed off to control flow of the cooling fluid to the airfoil 112 and, in the present embodiment, a cover plate 173 is provided to close off fluid flow to the openings 150*c* and 171. Cooling fluid is provided through the fluid openings 150*a* and 150*b* to the first and second pressure side cavities 130*a*, 130*b*, and flows in the pressure side serpentine path 129 in a downstream chordal direction, relative to the flow direction of the hot gases passing over the outer wall 116 of the airfoil 112. The cooling fluid passes out of the pressure side serpentine path 129 into the suction side serpentine path 137 through a transverse passage 152 defined through the central partition 132 at a lower edge 149 of the central partition 132 adjacent to the blade root 114. As illustrated, the transverse passage 152 comprises an opening between the cover plate 173 and the lower edge 149 of the central partition 132.

Referring to FIG. 7, the suction side serpentine path 137 comprises a first suction side passage 154 extending in a chordal direction from the first suction side cavity 138*a* to the second suction side cavity 138*b* adjacent the blade root 114, and a second suction side passage 156 extending in a chordal direction from the second suction side cavity 138*b* to the third suction side cavity 138*c* adjacent the blade tip 128. The cooling fluid flows in the suction side serpentine path 137 in an upstream chordal direction, relative to the flow direction of the hot gases passing over the outer wall 16 of the airfoil 112. The cooling fluid passes out of the suction side serpentine path 137 at the first suction side cavity 138*a* through a plurality of openings 160 (only one shown in FIG. 5) provided spaced in a spanwise direction in the suction sidewall 120. The openings 160 provide a film of cooling fluid to the suction sidewall 120 immediately downstream of the leading edge 122, where higher temperatures are typically experienced by the suction side of the airfoil 112. The openings 160 may comprise shaped openings to reduce the flow velocity of the cooling fluid as it exits the cooling holes 160.

The first pressure side cavity 130*a* comprises a leading edge cooling supply cavity. The cooling fluid enters the airfoil 112 through the openings 150*a* and 150*b* at its lowest temperature and the cooling fluid passing through the first pressure side cavity 130*a* initially provides cooling to the leading edge region, where the external heat load on the airfoil 112 is generally the greatest. The side walls of the first pressure side cavity 130*a* may further be provided with trip strips 162 along the interior surfaces thereof, as seen in FIGS. 5 and 6. The trip strips 162 increase turbulence of the cooling fluid flow along the interior surfaces, and thereby improve heat transfer at the boundary layer between the cooling fluid flow and the interior surfaces of the first pressure side cavity 130*a*.

Referring to FIGS. 5 and 6, heat transfer and balancing of the heat load throughout the airfoil 112 is further facilitated by a plurality of pin fins 164, defining banks of pin fins 164 in each of the pressure side cavities 130*a*, 130*b*, 130*c* and suction side cavities 138*a*, 138*b*, 138*c*, 138*d*. The pin fins 164 on the pressure side of the airfoil 112 extend from the interior surface of the pressure sidewall 118 to the central partition 132, and pin fins 164 on the suction side of the airfoil 112 extend from the suction sidewall 120 to the central partition 132. The pin fins 164 conduct heat from the airfoil outer wall 116 to the central partition 132, and increase turbulence and heat transfer to the cooling fluid passing through the serpentine paths 129, 137. In addition, the connection of the pin fins 164 to the common central partition 132 from both the pressure sidewall 118 and the suction sidewall 120 permits transfer of heat from a hotter side to a cooler side of the airfoil 112.

As seen in FIGS. 5 and 6, the trailing edge cavity 166 is in fluid communication with the third pressure side cavity 130*c* via a plurality of metering holes 168 defined in the rib 170. A plurality of trailing edge cooling holes 172 are provided in the trailing edge 124 of the airfoil 112 for exit of the cooling fluid from the trailing edge cavity 166. A plurality of pin fins 174 are provided extending through the trailing edge cavity 166 for balancing the thermal distribution between the pressure sidewall 118 and the suction sidewall 120. Further, a plurality of openings 176 are provided spaced in a spanwise direction in the pressure sidewall 118. The openings 176 may comprise shaped openings, and are located ahead of the bank of pin fins 174 in the trailing edge cavity 166 to provide a film of cooling fluid to the pressure sidewall 118 in an area adjacent the trailing edge 124 where higher temperatures are typically experienced by the pressure side of the airfoil 112.

Referring to FIGS. 6 and 7, the airfoil receives cooling fluid through the openings 150*a*, 150*b* and the cooling fluid passes toward the blade tip 128 through the first and second pressure side cavities 130*a*, 130*b*. Cooling fluid from the first pressure side cavity 130*a* passes through the first pressure side passage 146 and mixes with cooling fluid passing out of the second pressure side cavity 130*b*. The fluid from the first and second pressure side cavities 130*a*, 130*b* flows in a chordal direction from the leading edge 122 toward the trailing edge 124 through the second pressure side passage 148, and then flows through the third pressure side cavity 130*c* toward the blade root 114. At the end of the pressure side serpentine path 129, the cooling fluid passes through the transverse passage 152 into the suction side serpentine path 137, at the area generally identified by 155 in FIG. 7. The cooling fluid then passes sequentially in alternating spanwise directions through the third, second and first suction side cavities 138*c*, 138*b*, 138*a*, flowing in a chordal direction from the trailing edge 124 toward the leading edge 122 as it passes through the second and first pressure side passages 156, 154. The cooling fluid then passes out of the first suction side cavity 138*a* through the openings 160 to form a cooling fluid film over the region of the suction sidewall 118 adjacent the leading edge 122.

In addition to balancing the thermal distribution through the airfoil 12, 112 disclosed herein, the flow circuits defined by the paths 29, 37 and 129, 137 provide a further advantage in relation to the pressure distribution created by the hot gases flowing across the outer wall 16, 116 of the airfoil 12, 112, such as may be formed when a plurality of the airfoils are incorporated in a first row of blades within the turbine. Specifically, the discharge location for the paths 29, 37 and 129, 137 defined by the row of holes 60, 160 is provided at a low pressure region of the outer wall 16, 116, located on the suction side 20, 120 of the airfoil 12, 112. Accordingly, the cooling air may be provided through the pressure side passages 50 and 150*a*, 150*b* to the flow paths 29, 37 and 129, 137 at a lower supply pressure, which may provide an overall reduction in leakage flow of cooling fluid from the blades into the hot working fluid passing through the turbine.

It should also be understood that the provision of the pin banks formed by the plurality of pins 64, 164 extending through the flow paths 29, 37 and 129, 137 increases the through flow velocity of the cooling fluid and creates a highly turbulent flow, and thereby enhances the internal heat transfer coefficient values for the surfaces within the flow paths 29, 37 and 129, 137. Also, the intricate cooling passages provided by the pin banks throughout the serpentine flow of the cooling fluid reduces the negative effects on the heat transfer coefficient caused by rotational currents within the cooling fluid flow. As a result, the present design for the flow paths 29, 37 and 129, 137 provides a high internal convective cooling effectiveness, while also providing an improvement in the thermal balance between the pressure and suction sides of the airfoil 12, 112.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine blade comprising:

an airfoil including an airfoil outer wall extending radially outwardly from a blade root to a blade tip;

said airfoil outer wall including a pressure sidewall and a suction sidewall, said pressure and suction sidewalls joined together at chordally spaced leading and trailing edges of said airfoil;

a pressure side serpentine cooling path extending adjacent said pressure sidewall and comprising a plurality of cavities, each cavity extending in a spanwise direction between said blade root and said blade tip;

a suction side serpentine cooling path extending adjacent said suction sidewall and comprising a plurality of cavities, each cavity extending in a spanwise direction between said blade root and said blade tip;

a central partition extending chordally from said leading edge through said airfoil and defining an inner surface of each of said cavities of said pressure side cooling path and said suction side cooling path;

wherein said pressure side cooling path includes a first pressure side cooling cavity at said leading edge receiving cooling fluid entering said airfoil from a supply of cooling fluid and said pressure side cooling path conducts cooling fluid in a first chordal direction between said leading and trailing edges, and said suction side cooling path conducts cooling fluid in a second chordal direction, opposite said first chordal direction, between said leading and trailing edges;

said suction side cooling path includes a first suction side cooling cavity located adjacent to said first pressure side cooling cavity in the chordal direction wherein a chordal portion of said central partition defines an inner surface for both said first pressure side cooling cavity and said first suction side cooling cavity for effecting a transfer of heat from said first suction side cooling cavity through said chordal portion of said central partition to said first pressure side cooling cavity; and a transverse passage extending through said central partition and connecting said pressure side cooling path to said suction side cooling path, and including a trailing edge cavity in fluid communication with said pressure side cooling path, said trailing edge cavity including a plurality of openings for providing cooling fluid to said outer wall at said trailing edge, said transverse passage extending to a cooling cavity in said suction side cooling path from a cooling cavity in said pressure side cooling path adjacent to said trailing edge cavity.

2. The turbine blade of claim 1, including a plurality of heat conducting pin fins extending from said airfoil outer wall through said pressure side cavities and said suction side cavities to said central partition.

3. The turbine blade of claim 1, including a plurality of suction cavity pin fins extending through said first suction side cooling cavity between said suction sidewall and said chordal portion of said central partition, and a plurality of pressure cavity pin fins extending through said first pressure side cooling cavity between said pressure sidewall and said chordal portion of said central partition, wherein said suction cavity pin fins transfer heat from said suction sidewall adjacent to said leading edge to said chordal portion of said central partition and said pressure cavity pin fins transfer heat from said chordal portion of said central partition to said pressure sidewall to effect a balance in heat load between portions of said suction sidewall and said pressure sidewall adjacent to said leading edge.

4. The turbine blade of claim 1, including a first pressure side partition separating said first pressure side cavity from a second pressure side cavity, and a first suction side partition separating said first suction side cavity from a second suction side cavity wherein said first pressure side partition is chordally adjacent to said first suction side partition.

5. A turbine blade comprising:

an airfoil including an airfoil outer wall extending radially outwardly from a blade root to a blade tip;

said airfoil outer wall including a pressure sidewall and a suction sidewall, said pressure and suction sidewalls joined together at chordally spaced leading and trailing edges of said airfoil;

at least two pressure side cooling cavities located adjacent said pressure sidewall defining a pressure side path;

at least two suction side cooling cavities located adjacent said suction sidewall defining a suction side path;

a central partition extending chordally from said leading edge through said airfoil and defining an inner surface of each of said pressure side cooling cavities and said suction side cooling cavities;

a source of a cooling fluid in communication with a first one of said pressure side cooling cavities located at said leading edge of said airfoil, and at least one pressure side passage extending in a chordal direction for conducting cooling fluid in a downstream first chordal direction between said at least two pressure side cooling cavities;

a transverse passage extending through said central partition between one of said pressure side cavities and one of said suction side cavities;

at least one suction side passage extending in a chordal direction for conducting cooling fluid in an upstream second chordal direction opposite to said first chordal direction, between said at least two suction side cavities;

a transverse passage extending through said central partition between a pressure side cavity defining a last one of said pressure side cavities in said pressure side path and one of said suction side cavities in said suction side path, all of said cooling fluid in said suction side passage being provided from said pressure side passage through said transverse passage; and said suction side cooling cavities include a first suction side cooling cavity located adjacent to said first pressure side cooling cavity in the chordal direction wherein a chordal portion of said central partition defines an inner surface for both said first pressure side cooling cavity and said first suction side cooling cavity for effecting a transfer of heat from said suction side cooling cavity through said chordal portion of said central partition to said first pressure side cooling cavity.

6. The turbine blade of claim 5, wherein said pressure side cavities and said suction side cavities extend in a spanwise direction between said blade root to said blade tip for conducting said cooling fluid through said airfoil in a radial direction.

7. The turbine blade of claim 5, wherein cooling fluid conducted in said first chordal direction flows in a direction from said leading edge toward said trailing edge, and said cooling fluid conducted in said second chordal direction flows counter to said first chordal direction, in a direction from said trailing edge toward said leading edge.

8. The turbine blade of claim 5, wherein said cooling fluid exits said airfoil through openings in said first suction side cavity formed through said airfoil outer wall adjacent said leading edge.

9. The turbine blade of claim 5, including a plurality of pressure side heat conducting pin fins extending from said pressure sidewall, through said pressure side cavities to said central partition, and a plurality of suction side heat conducting pin fins extending from said suction sidewall, through said suction side cavities to said central partition.

10. The turbine blade of claim 5, wherein said pressure side cooling cavities include first, second and third pressure side cavities.

11. The turbine blade of claim 10, wherein cooling fluid enters said first pressure side cavity, adjacent said leading edge, and passes from said third pressure side cavity through said transverse passage to said one of said suction side cavities.

12. The turbine blade of claim 11, including a first pressure side passage extending between said first and second pressure side cavities, adjacent said blade tip, a second pressure side passage extending between said second and third pressure side cavities, adjacent said blade root, and wherein said transverse passage is located adjacent said blade tip.

13. The turbine blade of claim 12, wherein said suction side cooling cavities, in order from said leading edge toward said trailing edge, include first, second, third and fourth suction side cavities, including a first suction side passage extending between said first and second suction side cavities, adjacent said blade root, a second suction side passage extending between said second and third suction side cavities, adjacent said blade tip, and a third suction side passage extending between said third and fourth suction side cavities, adjacent said blade root, and said one of said suction side cavities comprises said fourth suction side cavity.

14. The turbine blade of claim 11, wherein cooling fluid additionally enters said airfoil through said second pressure side cavity, and including a first pressure side passage extending between said first and second pressure side cooling cavities, adjacent said blade tip, and a second pressure side passage extending between said second and third pressure side cavities, and wherein said transverse passage is located adjacent said blade root.

15. The turbine blade of claim 14, wherein said suction side cooling cavities, in order from said leading edge toward said trailing edge, include first, second and third suction side cavities, including a first suction side passage extending between said first and second suction side cavities, adjacent said blade root, and a second suction side passage extending between said second and third suction side cavities, adjacent said blade tip, and said one of said suction side cavities comprises said third suction side cavity.

16. The turbine blade of claim 5, including a plurality of suction cavity pin fins extending through said first suction side cooling cavity between said suction sidewall and said chordal portion of said central partition, and a plurality of pressure cavity pin fins extending through said first pressure side cooling cavity between said pressure sidewall and said chordal portion of said central partition, wherein said suction cavity pin fins transfer heat from said suction sidewall adjacent to said leading edge to said chordal portion of said central partition and said pressure cavity pin fins transfer heat from said chordal portion of said central partition to said pressure sidewall to effect a balance in heat load between portions of said suction sidewall and said pressure sidewall adjacent to said leading edge.

17. The turbine blade of claim 5, including a first pressure side partition separating said first pressure side cavity from a second pressure side cavity, and a first suction side partition separating said first suction side cavity from a second suction side cavity wherein said first pressure side partition is chordally adjacent to said first suction side partition.

* * * * *